US007881432B2

(12) United States Patent
Mitsuda et al.

(10) Patent No.: US 7,881,432 B2
(45) **Date of Patent: *Feb. 1, 2011**

(54) X-RAY FOCUSING DEVICE

(75) Inventors: Kazuhisa Mitsuda, Sagamihara (JP); Yuichiro Ezoe, Sagamihara (JP)

(73) Assignee: Japan Aerospace Exploration Agency, Tokyo (JP)

( * ) Notice: Subject to any disclaimer, the term of this patent is extended or adjusted under 35 U.S.C. 154(b) by 95 days.

This patent is subject to a terminal disclaimer.

(21) Appl. No.: 12/098,324

(22) Filed: Apr. 4, 2008

(65) Prior Publication Data

US 2009/0262900 A1 Oct. 22, 2009

Related U.S. Application Data

(63) Continuation of application No. 11/323,795, filed on Dec. 29, 2005.

(30) Foreign Application Priority Data

Jan. 14, 2005 (JP) ..... 2005-007263

(51) Int. Cl.
*G21K 1/06* (2006.01)

(52) U.S. Cl. ..... 378/84; 378/85; 378/147; 378/149

(58) Field of Classification Search ..... 378/84, 378/85, 147, 149, 154, 155; 250/505.1
See application file for complete search history.

(56) References Cited

U.S. PATENT DOCUMENTS 4,096,391 A 6/1978 Barnes
4,414,680 A 11/1983 Kraus
4,506,374 A 3/1985 Flynn
4,856,043 A 8/1989 Zola (Continued)

OTHER PUBLICATIONS

Extended European Search Report for EP Counterpart Patent No. 0525110.5 (Oct. 23, 2008).

(Continued)

*Primary Examiner*—Allen C. Ho
(74) *Attorney, Agent, or Firm*—Blakely, Sokoloff, Taylor & Zafman LLP.

(57) ABSTRACT

Disclosed is an X-ray reflecting device and an X-ray reflecting element constituting the X-ray reflecting device capable of facilitating a reduction in weight and being prepared in a relatively simple manner. The X-ray reflecting element of the present invention comprises a body made of a solid silicon, and a plurality of slits formed in the body in such a manner as to penetrate from a front surface to a back surface of the body. Each of the slits has a wall surface serving as an X-ray reflecting surface. To allow the slits in the respective X-ray reflecting elements to be located in a given positional relationship with each other, the X-ray reflecting device of the present invention comprises a plural number of the X-ray reflecting elements, which are formed into a multilayered structure in such a manner or arranged side-by-side in a horizontal direction in such a manner as to allow the slits in the respective X-ray reflecting elements to be located in a given positional relationship with each other, or stacked on each other in a vertical direction to form a stacked structure in such a manner as to allow the slits in the respective X-ray reflecting elements to be located in a given positional relationship with each other. Further, the X-ray reflecting device may comprise a plural number of the stacked structures arranged side-by-side in a horizontal direction.

3 Claims, 7 Drawing Sheets

U.S. PATENT DOCUMENTS

| | | | |
|---|---|---|---|
| 4,933,557 | A | 6/1990 | Perkins et al. |
| 5,233,193 | A | 8/1993 | Arakawa |
| 5,416,821 | A | 5/1995 | Frazier et al. |
| 5,418,833 | A | 5/1995 | Logan |
| 5,606,589 | A | 2/1997 | Pellegrino et al. |
| 6,018,566 | A | 1/2000 | Eberhard et al. |
| 6,047,044 | A | 4/2000 | Lehmann et al. |
| 6,185,278 | B1 | 2/2001 | Appleby et al. |
| 6,266,392 | B1 | 7/2001 | Fujinawa et al. |
| 6,301,334 | B1 | 10/2001 | Tybinkowski et al. |
| 6,307,917 | B1 | 10/2001 | Shimizu et al. |
| 6,396,902 | B2 | 5/2002 | Tybinkowski et al. |
| 6,408,054 | B1 | 6/2002 | Rahn et al. |
| 6,881,965 | B2 | 4/2005 | Bowen et al. |
| 7,127,037 | B2 | 10/2006 | Bowen et al. |
| 7,149,284 | B2 | 12/2006 | Ikhlef |
| 7,231,017 | B2 | 6/2007 | Gertsenshteyn et al. |

OTHER PUBLICATIONS

Citterio, O. et al., Large Light X-ray Optics: Basic Ideas and Concepts, Advances in Space Research, Mar. 31, 2003.

Beijersbergen, Marco, et al. "Silicon Pore Optics: Novel lightweight high-resolution X-ray optics developed for XEUS," in *SPIE*, vol. 5488, 2004, pp. 868-874.

Kondo, R, et al. "High aspect ratio electrostatic micro actuators using LIGA process," in *Microsystem Technologies* 6, 2000, pp. 218-221.

Kumakhov, M.A., et al. "A neutron lens," in *Nature*, vol. 357, Jun. 4, 1992, pp. 390-391.

Nilsson, D., et al. "Fabrication of silicon molds for polymer optics," in *Journal of Micromechanics and Microengineering*, Institute of Physics Publishing, 13, 2003, pp. S57-S61.

Song, Ki-Chang, et al. "Micromachined Silicon Optical Bench for the Low Cost Optical Module," in *SPIE*, vol. 3878, Sep. 1999, pp. 375-383.

Namioka, T., et al. "X-ray Image Formation Optics," Baifu-Kan, pp. 135-143.

Namioka, T. "X-Ray Image Formation Optics," X-Ray Imaging Optics, pp. 135-143, Kaku Yamamoto (Baifukan Co., Ltd.), Japan (Jul. 12, 1999).

X-RAY FOCUSING DEVICE

CROSS REFERENCE TO RELATED APPLICATIONS

This application is a continuation of and claims priority from co-pending U.S. patent application Ser. No. 11/323,795 filed on Dec. 29, 2005.

BACKGROUND OF THE INVENTION

1. Field of the Invention

The present invention relates to an X-ray focusing device for used in X-ray monitors in outer space, or radiation counters or microanalyzers on the ground.

2. Description of the Background Art

Differently from visible light, a normal-incidence optics is difficult to use for X-rays. Therefore, a grazing-incidence optics utilizing total reflection from a metal surface based on a property of metals, i.e. a refractive index less than one for X-rays, is used for X-rays. In view of the fact that a critical angle for the total reflection of X-rays has a small value of about 1 degree, the grazing-incidence optics has to be designed to ensure a sufficient effective area of a reflecting surface. In this context, there has been known a technique of concentrically arranging a plurality of metal cylindrical-shaped reflecting mirrors different in diameter. This technique, however, leads to a problem; namely an increase in total weight of an obtained X-ray reflecting device, which makes it difficult to transport the device from the ground for use in outer space.

Further, each reflecting mirror in the X-ray reflecting device can have a certain level of reflectance only if its surface has smoothness to the degree of an X-ray wavelength. For this purpose, the conventional X-ray reflecting device has been prepared by subjecting each reflecting surface to a polishing process, so as to ensure a desired surface smoothness. As a measure to ensure the desired smoothness, there has been developed a technique of preparing a numbers of replica mirrors by pressing a thin film onto a polished master block (see "X-ray Imaging Optics, T. Namioka, K. Yamashita, BAIFUKAN Co., Ltd.": Non-Patent Document 1.) In either case, a number of reflecting mirrors have to be prepared one by one by spending a lot of time and effort.

With the aim of achieving a reduction in weight, an X-ray reflecting device using silicon pore optics has also been proposed (see "Beijersbergen et al., (2004) Proc. SPIE Vol. 5488, pp. 868-874": Non-Patent Document 6). This device comprises a plurality of polished silicon substrates each having a front surface serving as a reflecting mirror and a back surface formed with a groove for ensuring an X-ray optical path, wherein the adjacent silicon substrates are arranged in close contact with one another. However, this reflecting device is limited in weight reduction achieved, because the thickness (usually referred to as "P") of walls which define slits (which corresponds to slits $\mathbf{12}_1, \mathbf{12}_2, \ldots, \mathbf{12}_n$ in the undermentioned FIG. 1) is determined by a thickness (200 to 500 μm) of each of the silicon substrates. Moreover, the polished mirrors take a lot of time and effort to be prepared, as with the above metal-based device.

While an optics using a glass fiber as an X-ray waveguide has recently come into practical use (see, for example, "Kumakov & Sharov (1992) Nature 357, 390": Non-Patent Document 2), it involves a problem about an increase in cost.

SUMMARY OF THE INVENTION

In view of the above problems, it is therefore an object of the present invention to provide an X-ray reflecting device and an X-ray reflecting element constituting the X-ray reflecting device, capable of facilitating a reduction in weight and being prepared in a relatively simple manner.

In order to achieve this object, according to a first aspect of the present invention, there is provided an X-ray reflecting element comprising a body composed of a silicon or metal plate, and a plurality of slits formed in the body in such a manner as to penetrate from a front surface to a back surface of the body. Each of the slits has a wall surface serving as an X-ray reflecting surface. The slits are formed through an etching process when the body is composed of a silicon plate or through an X-ray LIGA process when the body is composed of a metal plate.

In the X-ray reflecting element of the present invention, the X-ray reflecting surface may have a surface roughness of 100 angstroms or less, more preferably 30 angstroms or less.

In the X-ray reflecting element of the present invention, the body may include fastening means for allowing a plural number of the X-ray reflecting elements to be fastened to each other.

According to a second aspect of the present invention, there is provided an X-ray reflecting device comprising a plural number of the X-ray reflecting elements set forth in the first aspect of the present invention. To allow the slits in the respective X-ray reflecting elements to be located in a given positional relationship with each other, the plurality of X-ray reflecting elements are formed into a layered structure in such a manner as to allow the slits in the respective X-ray reflecting elements to be located in a given positional relationship with each other, or arranged side-by-side in a horizontal direction, or stacked on each other in a vertical direction to form a stacked structure in such a manner as to allow the slits in the respective X-ray reflecting elements to be located in a given positional relationship with each other. Further, the X-ray reflecting device may comprise a plural number of the stacked structures arranged side-by-side in a horizontal direction.

In the X-ray reflecting device of the present invention, the plurality of X-ray reflecting elements may be arranged side-by-side, or stacked in a vertical direction, in such a manner as to allow the slits in the respective X-ray reflecting elements to be located in a given positional relationship with each other, so as to approximately form as an X-ray collecting/focusing optics based on a combination of the slits.

As mentioned above, in the X-ray reflecting element of the present invention, the slits are formed in the body in a solid lump through an etching process when the body of the elements is composed of a silicon plate or through an X-ray LIGA process when the body of the elements is composed of a metal plate. This makes it possible to facilitate formation of the slits. Further, even at the current technical level, the etching process or X-ray LIGA process allows the slits to be formed with a wall surface roughness of at least 100 angstroms or less, or 30 angstroms or less, so that each wall surface of the slits can be used as a desirable X-ray reflecting surface. Thus, the X-ray reflecting element can be formed in a relatively simple manner.

In addition, the etching process or X-ray LIGA process allows each of the slits to be formed with a micro-gap. Thus, the X-ray reflecting element can be reduced in size and weight to prevent an increase in weight of an X-ray reflecting device to be obtained by combining a plural number of the X-ray reflecting element together. This is significantly advantageous, particularly, for an X-ray reflecting device for use in outer space.

DESCRIPTION OF THE PREFERRED EMBODIMENTS

With reference to the drawings, one embodiment of the present invention will now be described.

Figure 1:
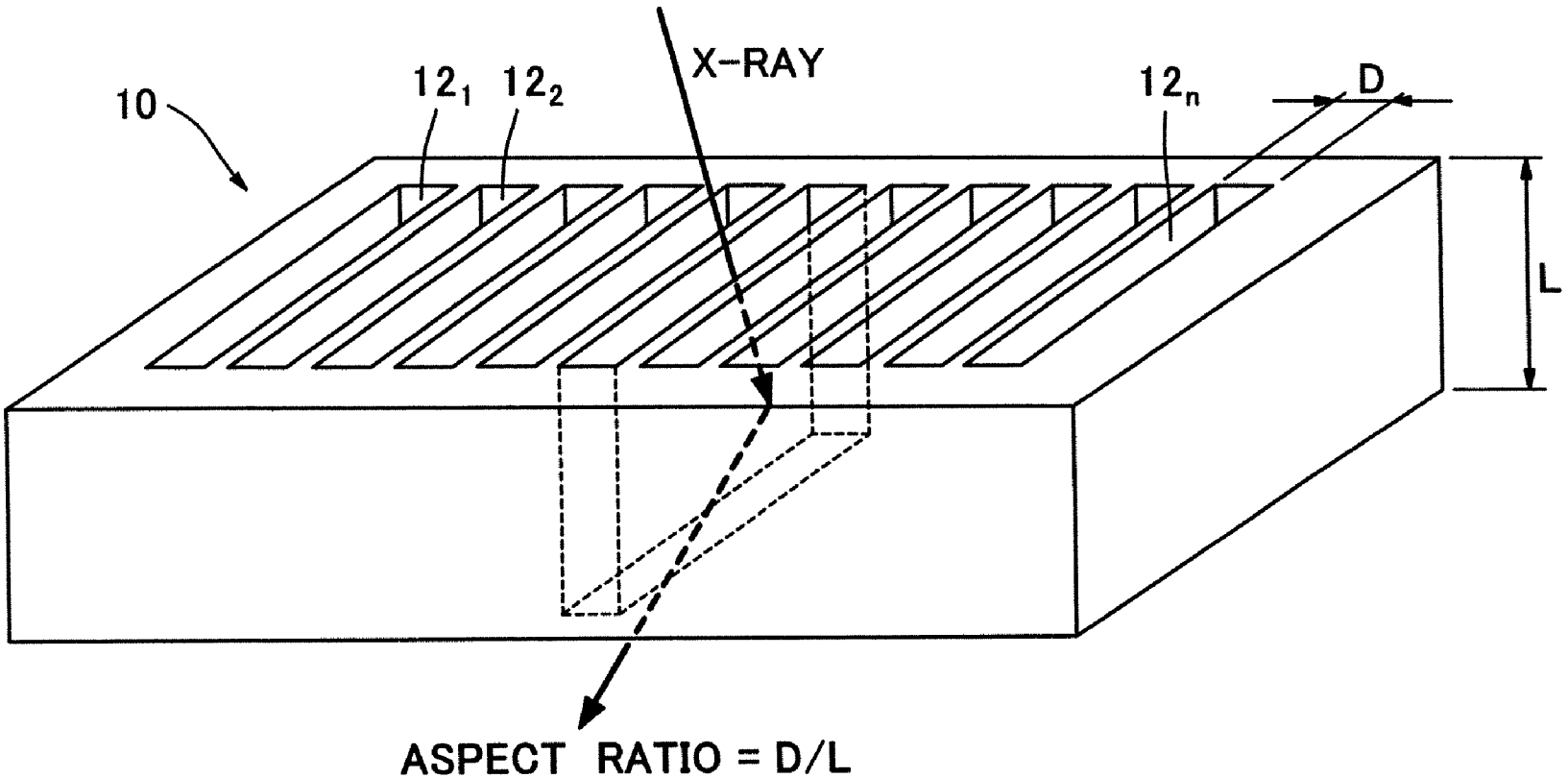
FIG. 1 is a perspective view showing an X-ray reflecting element according to one embodiment of the present invention.

FIG. 1 is a perspective view showing an X-ray reflecting element 10 according to one embodiment of the present invention. The X-ray reflecting element 10 illustrated in FIG. 1 generally has an approximately rectangular shape. The X-ray reflecting element 10 has a number of slits formed through an etching process to penetrate therethrough vertically. Specifically, the X-ray reflecting element 10 illustrated in FIG. 1 is prepared by placing a mask on a silicon wafer having a thickness L, and forming a number of slits $\mathbf{12}_1$, $\mathbf{12}_2$, - - - (when a specific one of the slits is not designated, each or all of the slits are defined by a reference numeral 12), each having a gap or width D, in a direction perpendicular to the silicon wafer at a pitch of about 10 μm or less through an anisotropic etching process or a combinational process of a dry etching process and an anisotropic etching process.

The X-ray reflecting element 10 may be made of a metal material. In this case, a metal plate is prepared by forming a resist pattern having a negative configuration relative to that of the element in FIG. 1, and forming a structure with a number of slits through an X-ray LIGA process using the resist pattern as a template. The metal to be used as a material of the X-ray reflecting element may be nickel which has a high X-ray reflectance and a proven reliability in forming a structure through the X-ray LIGA process.

In this embodiment, each side or lateral wall of the slits 12 formed in the above manner is used as a reflecting surface for X-rays. Specifically, an X-ray enters into either one of slits from above the X-ray reflecting element 10. Then, the X-ray is reflected by the lateral wall of the slit, and emitted out of the slit downward.

From previous researches on semiconductor processes, it is know that, when such a lateral wall is formed by subjecting a silicon substrate to an anisotropic etching process, or a combinational process of an anisotropic etching process and another wet etching process or a dry etching process, or subjecting a metal substrate to an X-ray LIGA process, an extremely smooth surface having a surface roughness of about several ten angstroms can be obtained (see "Song et al., (1999) SPE 3878, 375": Non-Patent Document 3, "Kondo et al., 2000, Microsystem. Technologies, 6, 218: Non-Patent Document 4, "Nilsson et al., 2003, J. Micromech. Michroeng., 13, 57": Non-Patent Document 5). However, there has been no conception of using such a wall as an X-ray mirror.

In FIG. 1, a ratio D/L of the width D of the slit 12 to the thickness L of the X-ray reflecting element 10 will hereinafter be referred to as "aspect ratio". An X-ray reflecting device capable of efficiently collecting or focusing X-rays can be achieved only if the aspect ratio is set approximately to a certain value near a critical angle for the total reflection of X-rays. If D=10 μm is achieved through an etching process, a conventional cylindrical-shaped X-ray reflecting device, which previously had a length (a length of an axis of the cylinder) of several cm to several ten cm, can have a length of 1 mm or less.

Figure 2:
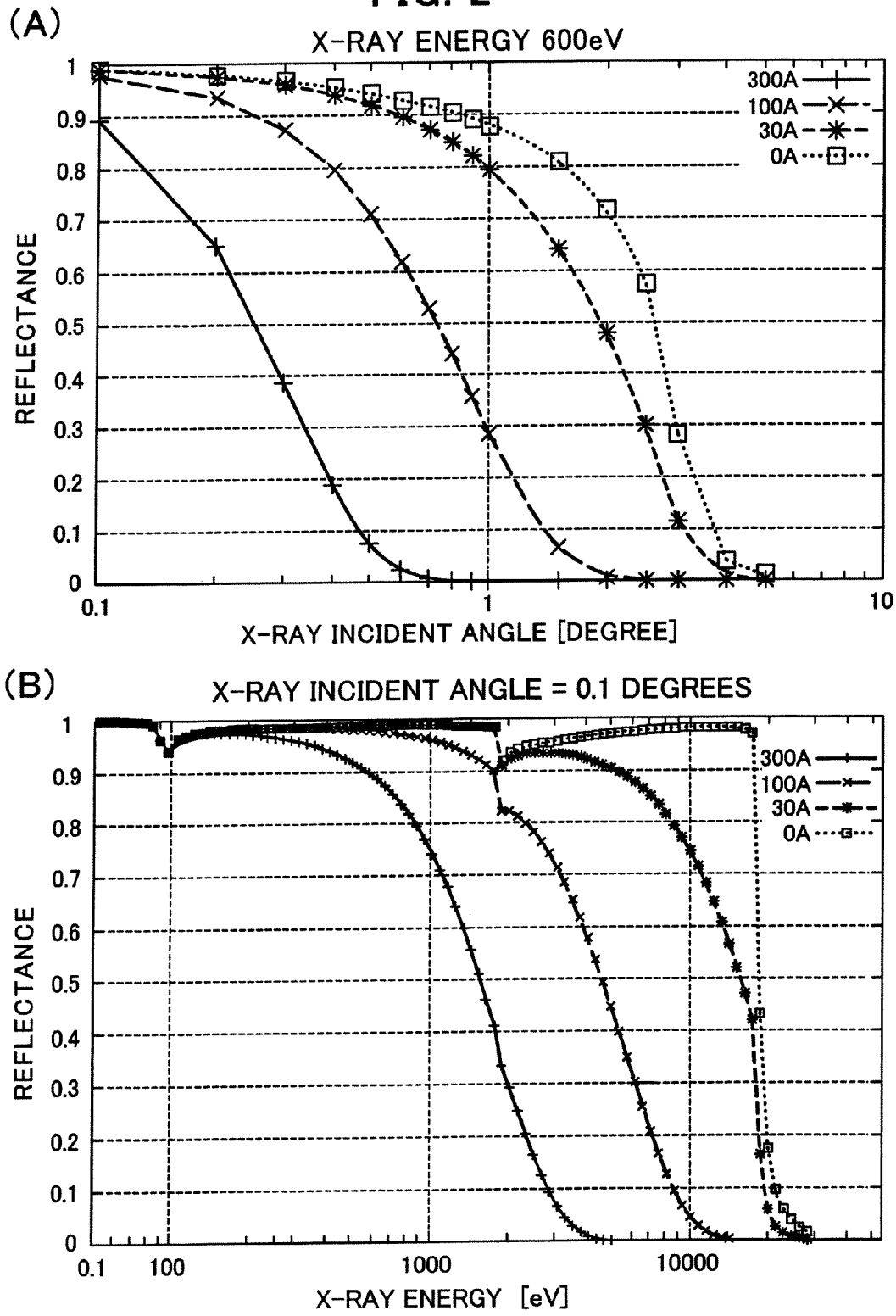
FIGS. 2(A) and 2(B) are graphs showing a calculation result of a reflectance of X-rays in a reflecting surface of a silicon substrate subjected to an etching process.

It is known that an X-ray reflectance is a function of an X-ray energy, an X-ray incident angle and a surface roughness. FIG. 2 is a graph showing a calculation result of an X-ray reflectance. FIG. 2(A) shows changes in X-ray reflectance depending on an X-ray incident angle, under the conditions that an X-ray energy is fixed at 600 eV, and a surface roughness is fixed at 0, 30, 100 or 300 angstroms. FIG. 2(B) shows changes in X-ray reflectance depending on an X-ray energy, under the conditions that an X-ray incident angle is fixed at 0.1 degrees, and a surface roughness is fixed in the same manner as that in FIG. 2(A).

At the current technical level, a silicon wafer can be subjected to an etching process to obtain a surface having a surface roughness of about 30 angstroms or less. As seen in FIGS. 2(A) and 2(B), on the assumption that the silicon wafer has a surface roughness of 30 angstroms, the silicon wafer exhibits an excellent reflectance substantially equal to an optimal surface (roughness=zero angstrom) for soft X-rays having an X-ray energy of 1 keV or less.

Preferably, the lateral wall serving as a reflecting surface is formed to have a surface perpendicular to a principal surface or front and back surfaces of the silicon wafer, as shown in FIG. 1. For example, a silicon wafer having the (110) face along a front surface thereof is subjected to an etching process using a KOH solution as an etching liquid, in such as manner as to form a slit with a lateral surface having the (111) face perpendicular to the (110) face. Alternatively, a silicon substrate carved out to have a front surface slightly inclined relative to the (111) face may be subjected to an etching process to obtain a slit with a lateral wall slightly inclined relative to the front surface of the silicon substrate. For the anisotropic etching process, various etching liquids, such as TMAH and hydrazine, may be used as well as KOH.

If it is necessary to form a deep opening so as to increase an effective area for reflection, a deep hole may be formed in a substrate through a dry etching process, and then subjected to an anisotropic etching process to smoothly finish a lateral wall thereof (see the Non-Patent Document 5).

Instead of the X-ray reflecting element made of silicon prepared based on an anisotropic etch technique using a silicon wafer as shown in FIG. 1, an X-ray reflecting element made of metal, such as nickel, may be prepared by fabricating a resist pattern with a high degree of accuracy through an X-ray LIGA process, and electrodepositing nickel using the resist pattern as a template (see the Non-Patent Document 4). While a surface accuracy in this technique is determined by energy of irradiated light to be used in the X-ray LIGA process, a surface accuracy equal to or higher than that in a silicon substrate subjected to a wet etching process can be expected if X-rays having a high energy of 10 keV or more are used in the X-ray LIGA process. For example, such high-energy X-rays may be formed using a large-scale light radiation facility (Spring-8) of the Japan Synchrotron Radiation Research Institute.

The metal plate-shaped X-ray reflecting element (not shown) prepared through the X-ray LIGA process may be used in the same manner as the aforementioned X-ray reflecting element made of silicon. The X-ray reflecting element prepared through the X-ray LIGA process has advantages, for example, of being able to use a metal having a larger atomic number than that of silicon so as to achieve a higher reflectance, and to allow the lateral wall of the slit to be formed as a curved surface so as to provide an enhanced X-ray focusing performance.

Figure 4:
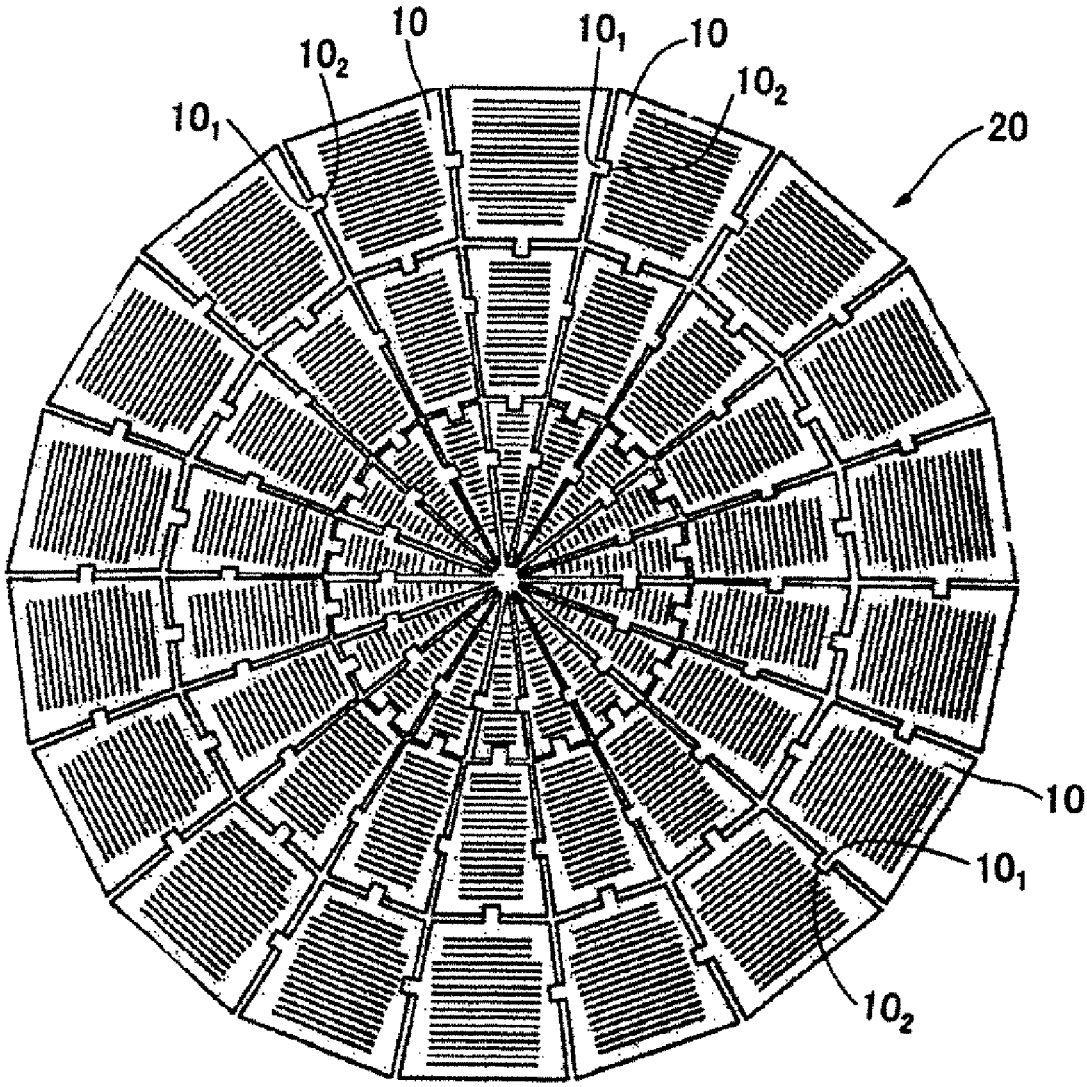
FIG. 4 is a top plan view showing an X-ray reflecting device according to one embodiment of the present invention.
Figure 5:
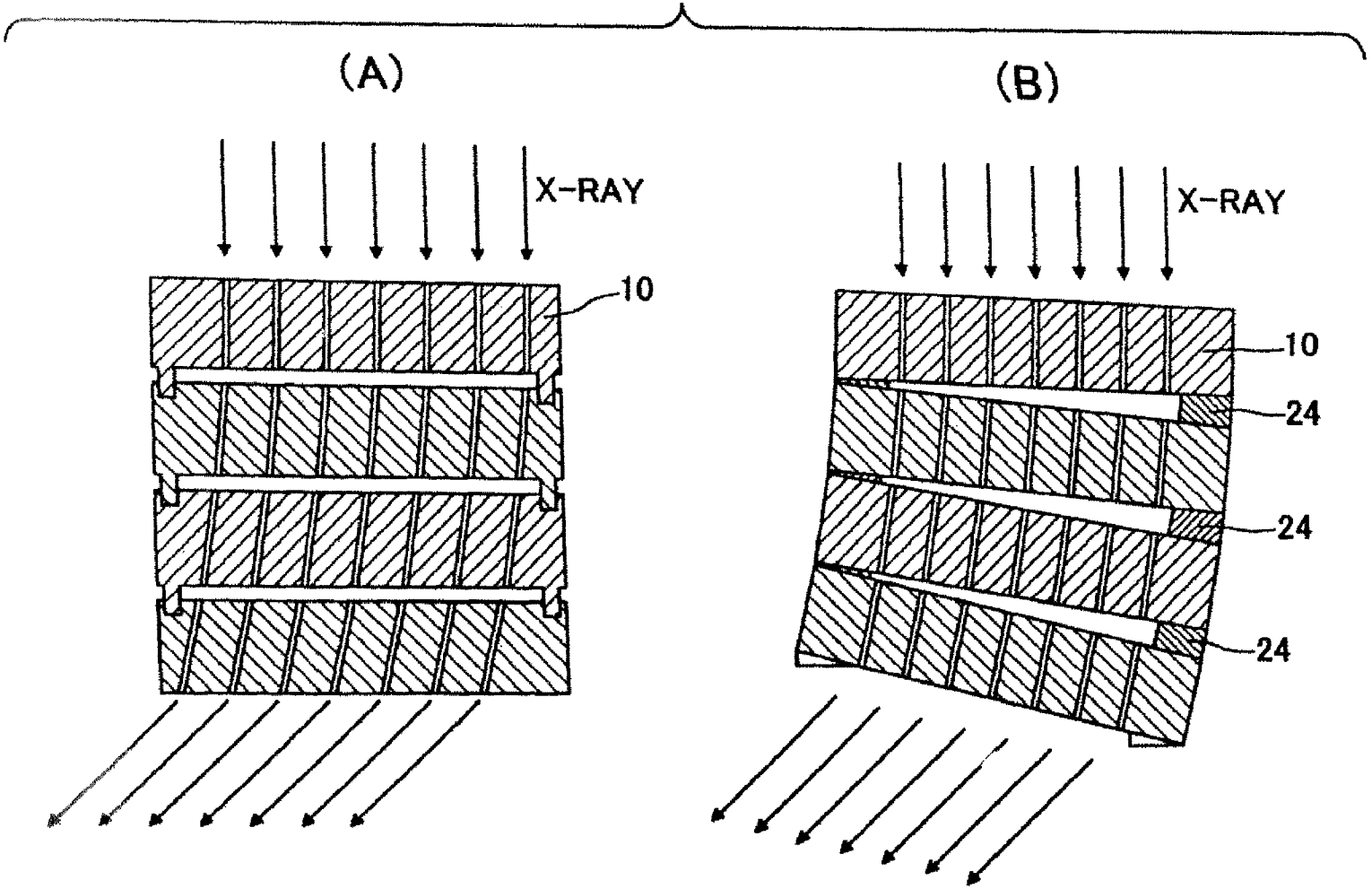
FIGS. 5(A) and 5(B) are fragmentary sectional views showing the X-ray reflecting device in FIG. 4.

While the X-ray reflecting element 10 in FIG. 1 generally has a rectangular shape, it may be formed to have a fan or sector shape, as shown in FIGS. 4 and 5 and described in detail later. The X-ray reflecting element 10 may be formed with concave and convex portions at a position where they do not hinder the original functions, e.g. in a peripheral portion or an upper or lower portion thereof. When a plural number of the X-ray reflecting elements 10 are stacked on each other or arranged side-by-side, as described later, the concave and convex portions are used for positioning and fastening the X-ray reflecting elements 10 to each other.

Figure 3:
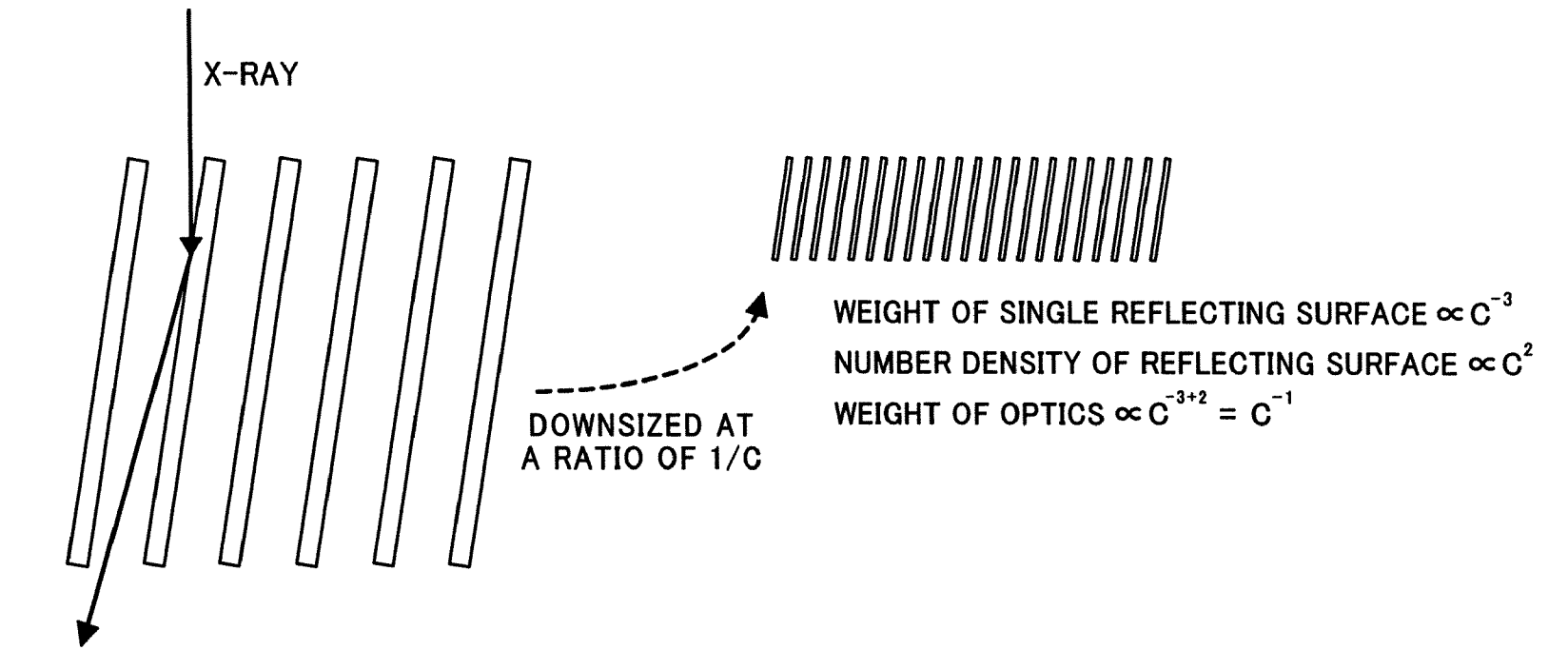
FIG. 3 is an explanatory schematic diagram of the level of reduction in weight in the X-ray reflecting element according to the embodiment as compared with that in a conventional X-ray reflecting mirror

FIG. 3 is a schematic diagram showing the level of reduction in weight in the X-ray reflecting element (on the right side in FIG. 3) in FIG. 1 as compared with a conventional X-ray reflecting mirror (on the left side in FIG. 3). If a single X-ray reflecting surface in the X-ray reflecting element according to this embodiment is downsized at a ratio of 1/C relative to that of the conventional mirror, the single X-ray reflecting surface will have a weight reduced in proportion to $C^{-3}$, and a number density increased in proportion to $C^2$. That is, an optics (e.g. an after-mentioned X-ray reflecting device 20 illustrated in FIG. 4) to be formed of a plural number of the X-ray reflecting elements according to this embodiment is reduced in weight in proportion to $C^{-3+2}=C^{-1}$ as a rough estimate. Further, as described above, the width and pitch of each slit of the X-ray reflecting element according to this embodiment can be set at a significantly small value of about 10 μm, or the value of C is extremely large. Thus, the optics can have a weight reduced by about two in a digit number.

An X-ray reflecting device prepared by combining a plural number of the X-ray reflecting elements 10 in FIG. 1 together will be described below.

FIG. 4 is a top plan view showing an X-ray reflecting device 20 prepared by closely arranging a plurality of the sector-shaped X-ray reflecting elements 10 to form a circular shape. FIGS. 5(A) and 5(B) are fragmentary sectional views of the X-ray reflecting device 20. As shown in FIGS. 5(A) and 5(B), four of the X-ray reflecting elements 10 are stacked in a vertical direction to form a stacked or layered structure, and X-rays enter into the slits of the X-ray reflecting elements 10 from above the drawing sheet of FIG. 4.

As shown in FIG. 4, each of the X-ray reflecting elements 10 has a convex portion 101 and a concave portion 102 each formed at a given position in such a manner as to allow the convex portion 101 and the concave portion 102 formed, respectively, in the horizontally adjacent X-ray reflecting elements 10 to be fitted into one another.

As described in connection with FIG. 1, a large number of slits are formed in each of the X-ray reflecting elements 10 in FIG. 5(A). In one arrangement illustrated in FIG. 5(A), as to an angle of the slits relative to a front surface in each of the X-ray reflecting elements, the slits of the X-ray reflecting element in the lower layer are increased in the slit angle as compared with that of the X-ray reflecting element in the upper layer, as shown in FIG. 5(A). This is intended to gradually incline the reflecting surfaces in a direction from the upper layer toward the lower layer within a range allowing the total reflection of X-rays to be maintained, so as to allow the X-rays to be finally focused onto a given zone.

In another arrangement illustrated in FIG. 5(B), while an angle of each of the slits relative to a front surface in each of the X-ray reflecting elements 10 is designed to be the same, the X-ray reflecting elements 10 themselves are arranged to have a gradually increased inclination in a direction from the upper layer toward the lower layer, so as to allow the X-rays to be finally focused onto a given zone. For this purpose, a support member 24 is interposed between the adjacent X-ray reflecting elements to allow the slits in each of the layers to have a given angle.

The X-ray reflecting device 20 obtained in the above manner can be significantly reduced in weight as compared with the conventional device, as described in connection with FIG. 3. This provides an advantage of being able to provide an X-ray reflection device suitable for transport for use in outer space, for example, in the state when the X-ray reflecting device 20 is placed on a satellite.

Figure 6:
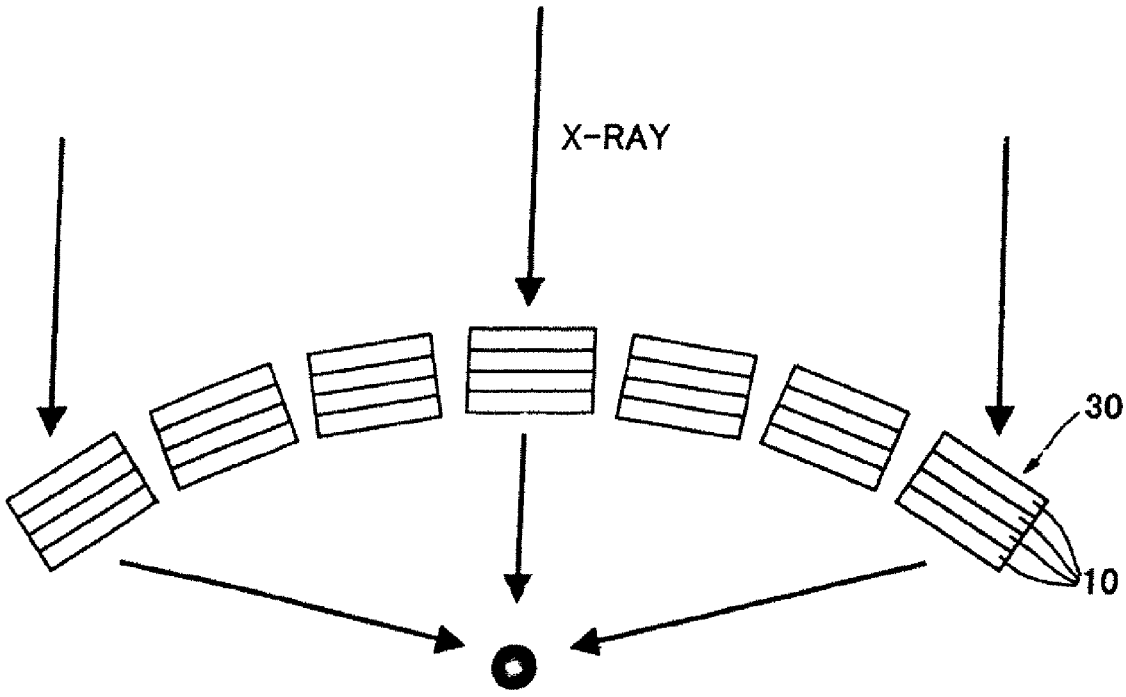
FIG. 6 is a schematic diagram showing an X-ray reflecting device according to another embodiment of the present invention.

FIG. 6 shows an X-ray reflecting device 30 prepared by stacking four of X-ray reflecting elements 10 in FIG. 1 on each other to form a stacked or layered structure as shown in FIG. 5, and then arranging a plural number of the stacked structures side-by-side along a hypothetical spherical surface, so as to form a so-called "lobster eye optics". X-rays entering from above the X-ray reflecting device 30 are collected through the X-ray reflecting device 30, and focused onto a narrow zone on the side opposite to the incident side. Alternatively, an optics similar to a Woelter type I x-ray optics may be prepared by arranging a plural number of the X-ray reflecting elements 10 in a planar pattern while changing an inclination of each of the X-ray reflecting elements 10, to form a planar structure, and stacking two or four of the planar structures on each other.

Figure 7:
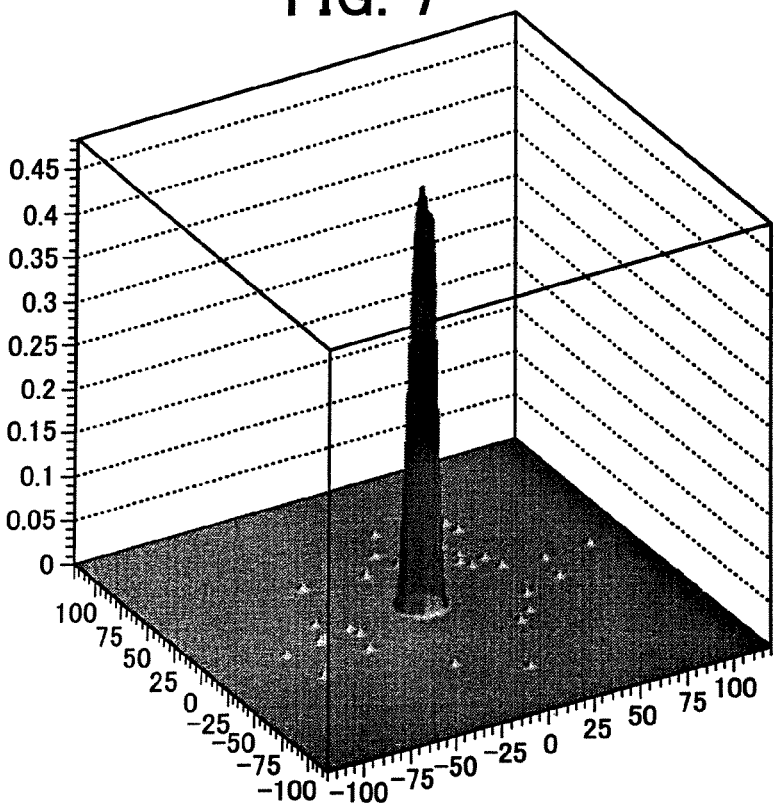
FIG. 7 is a graph showing a simulation result of X-ray focusing to be obtained when X-rays enter in parallel into the X-ray reflecting device in FIG. 6.

FIG. 7 is a graph (arbitrary unit) showing a simulation result of X-ray focusing to be obtained when X-rays enter in parallel into the X-ray reflecting device 30 in FIG. 6. According to this graph, a peak of the collected/focused X-ray can be observed in the center of the field of vision.

Figure 8:
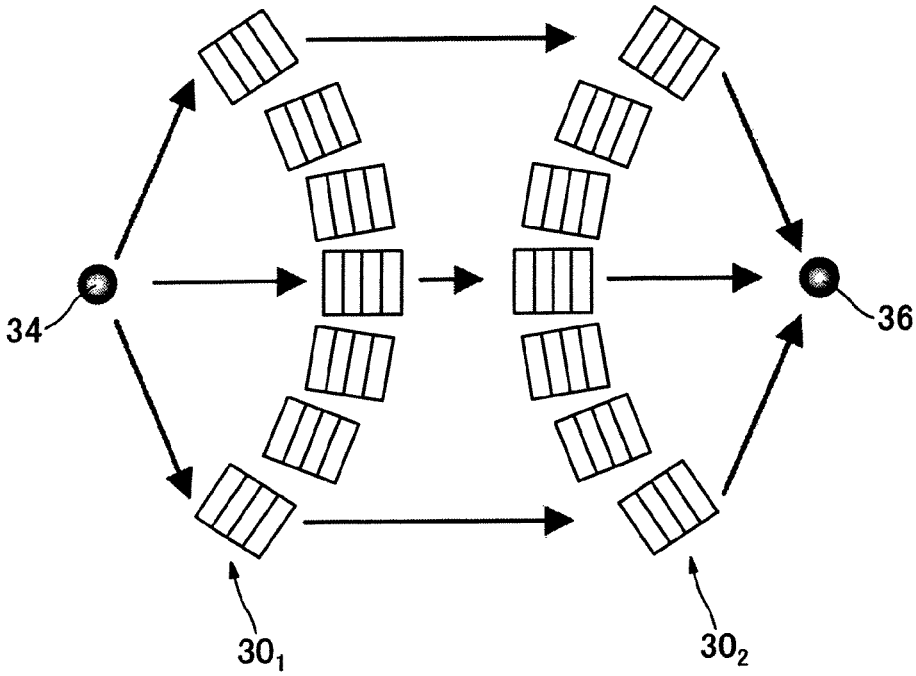
FIG. 8 is a schematic diagram showing one example of an X-ray reflecting device of the present invention applicable to microanalysis.

FIG. 8 shows an optics prepared by arranging two of the X-ray reflecting devices 30 in FIG. 6. X-rays emitted from a single left point 34 are converted to parallel rays through the left X-ray reflecting device $\mathbf{30}_1$, and the parallel rays are re-focused onto a point 36 through the right X-ray reflecting device $\mathbf{30}_2$.

The optics illustrated in FIG. 8 is one example of optics used on the ground. For example, the optics may be used in a microanalysis for detecting a slight amount of X-rays emitted from a target substance irradiated with electron beams from an electron beam source, to identify the substance. In particular, this optics can be effectively used when an X-ray detector cannot be placed at a position close to a target substance.

As compared with the conventional device, each of the X-ray reflecting devices in FIGS. 6 and 8 can be drastically reduced in weight, and prepared in a simple manner.

What is claimed is:

1. An X-ray reflecting device comprising a plural number of X-ray reflecting elements, each of said X-ray reflecting elements comprising:

a body composed of a silicon plate; and a plurality of slits formed in said body through an etching process in such a manner as to penetrate from a front surface to a back surface of said body, each of said slits having a wall surface serving as an X-ray reflecting surface, wherein said plurality of X-ray reflecting elements are arranged side-by-side in a horizontal direction in such a manner as to allow said slits in the respective X-ray reflecting elements to be located in a given positional relationship with each other to allow X-rays incident from one side of the X-ray reflecting device to be collected through the X-ray reflecting device and focused onto a narrow zone on a side opposite to said one side.

2. An X-ray reflecting element comprising:

a body composed of a metal plate; and a plurality of slits formed in said body through an X-ray LIGA process in such a manner as to penetrate from a front surface to a back surface of said body, each of said slits having a wall surface serving as an X-ray reflecting surface to allow X-rays incident from one side of the X-ray reflecting element to be collected through the X-ray reflecting element and focused onto a narrow zone on a side opposite to said one side.

3. An X-ray reflecting device comprising a plural number of X-ray reflecting elements, each of said X-ray reflecting elements comprising:

a body composed of a metal plate; and a plurality of slits formed in said body through an X-ray LIGA process in such a manner as to penetrate from a front surface to a back surface of said body, each of said slits having a wall surface serving as an X-ray reflecting surface, wherein said plurality of X-ray reflecting elements are arranged side-by-side in a horizontal direction in such a manner as to allow said slits in the respective X-ray reflecting elements to be located in a given positional relationship with each other to allow X-rays incident from one side of the X-ray reflecting device to be collected through the X-ray reflecting device and focused onto a narrow zone on a side opposite to said one side.

* * * * *